United States Patent [19]

Fillery

[11] 3,976,024

[45] Aug. 24, 1976

[54] BOAT HATCHES WITH DUAL ESPAGNOLETTE BOLTS FOR HINGING AND LOCKING

[75] Inventor: Gordon Thomas Fillery, Cannes, France

[73] Assignee: Crest Nicholson Limited, England

[22] Filed: May 20, 1975

[21] Appl. No.: 579,250

[30] Foreign Application Priority Data

June 4, 1974 United Kingdom ..... 24598/74

[52] U.S. Cl. ..... 114/203; 16/147; 49/193; 114/201 R; 292/40

[51] Int. Cl.[2] ..... B63B 19/14; E05D 15/50

[58] Field of Search ..... 114/203, 201 R; 49/192, 49/193; 160/188; 292/40; 16/147

[56] References Cited

UNITED STATES PATENTS

| | | | |
|---|---|---|---|
| 972,639 | 10/1910 | Pians | 16/147 |
| 1,679,526 | 8/1928 | Isherwood et al. | 114/201 |
| 2,312,155 | 2/1943 | Flaxman | 114/201 |
| 3,861,083 | 1/1975 | Goiot | 49/193 |

FOREIGN PATENTS OR APPLICATIONS

| | | | |
|---|---|---|---|
| 42,844 | 8/1930 | Denmark | 49/193 |
| 928,453 | 11/1954 | Germany | 49/193 |

*Primary Examiner*—Trygve M. Blix
*Assistant Examiner*—Charles E. Frankfort
*Attorney, Agent, or Firm*—Flynn & Frishauf

[57] ABSTRACT

A hatch assembly for a boat has a hatch cover and a hatch mounting frame to which the cover is hinged by releasable hinges, there being two espagnolette bolts serving the dual functions of hinging and latching the hatch cover to the mounting frame; retraction of either espagnolette bolt at will from an associated hinge receiver on the mounting frame enabling the hatch cover to be swung open left or right handedly, and retraction of both bolts from their receivers enabling the hatch cover to be lifted clear of the mounting frame.

6 Claims, 12 Drawing Figures

FIG. 1
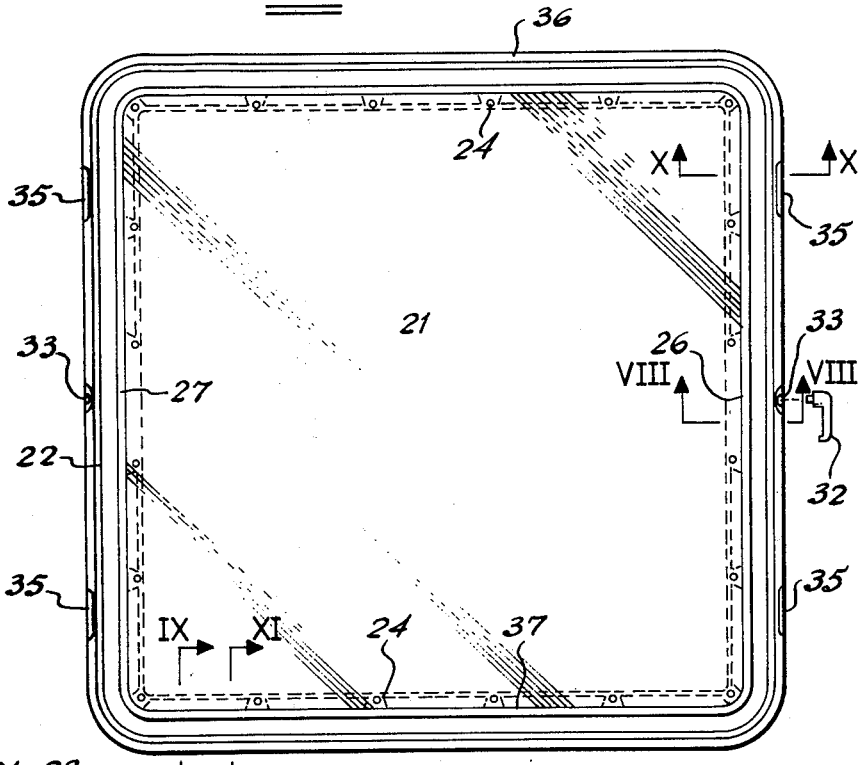
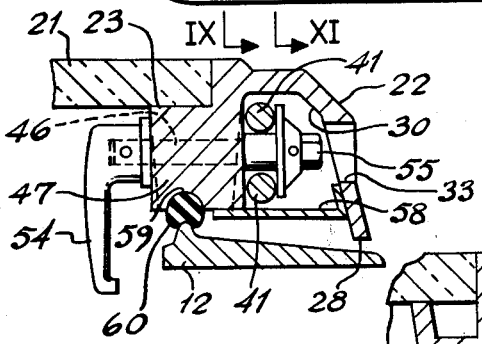
FIG. 8
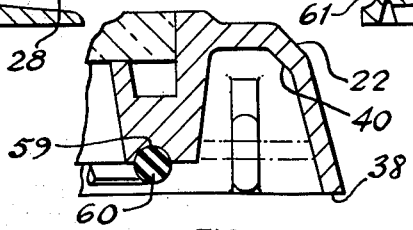
FIG. 9
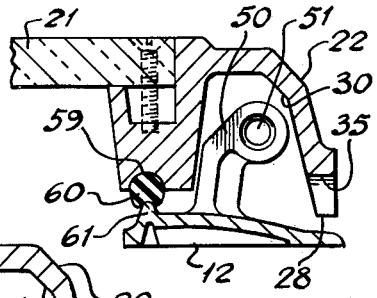
FIG. 10

42
41
45
49
43
44
31

46
54
55
32

22
40
68
38
21
23
59
60
61
12

BOAT HATCHES WITH DUAL ESPAGNOLETTE BOLTS FOR HINGING AND LOCKING

The present invention relates to an improved hatch, inter alia for boats and ships.

According to the present invention, there is provided a hatch assembly comprising a hatch cover, a hinge coupling for hingedly connecting the hatch cover to a hinge-receiving means of a hatch mounting, and means for latching the hatch in a closed position, the hinge coupling being operable to retract and detach the same from the hinge-receiving means so as to allow the hatch cover to be removed from the mounting when the latching means is also released.

The latching means is preferably served by a second retractable hinge coupling which releasably and hingedly connects the hatch cover to a second, associated hinge-receiving means. Thus, in a generally square or rectangular hatch, the two hinge couplings can be disposed on the opposed sides of the hatch cover. The hinge axes are then arranged parallel to the associated sides. Release of one or the other hinge coupling enables the hatch cover to be swung open either left or right-handedly about the hinge coupling which remains connecting the hatch cover to the associated hatch mounting. The hatch cover can be detached bodily from its mounting by releasing both hinge couplings.

Preferably, the or each hinge coupling is releasable from on deck or from within the boat.

Conveniently, the or each hinge coupling is an espagnolette bolt having bolt or hinge pins to be rotatably accommodated in the associated hinge receiving means intended, in use, to be secured to the deck of the boat.

Brackets for mounting directly on deck can incorporate the hinge receiving means and themselves serve as hatch mounting means for hatch assemblies embodying the invention.

Preferably, however, the hatch mounting comprises a base member which is in the form of a frame for securing around a deck hatch opening, the frame including hinge receivers which in a preferred embodiment cooperate with both espagnolette bolts to provide for latching as well as hinging of the hatch cover.

Desirably, the hatch cover is provided with a sealing gasket to prevent water leakage through the hatch when closed. Advantageously, the hatch cover is glazed.

The invention comprehends the hatch cover when fitted to the hatch mounting.

BRIEF DESCRIPTION OF THE DRAWINGS

The present invention will now be described by way of example only with reference to the accompanying drawings, in which:

FIG. 1 is a general plan view of a hatch assembly embodying the invention,

FIG. 8 is a sectional view taken on the line VIII—VIII of FIG. 1, FIG. 9 is a sectional view taken on the line IX—IX of FIG. 1, FIG. 10 is a sectional view taken on the line X—X of FIG. 1.

DETAILED DESCRIPTION

The hatch assembly illustrated here comprises a hatch cover 11 and a base frame 12. The frame 12 is intended to be secured around a deck opening 13 and to serve as a coaming therefor. It will be appreciated that the frame 12 will be secured to the deck 14, e.g. by bolting, with a sealing material such as a mastic intervening between the two.

The hatch cover 11 is hingedly connected to the base frame 12. In the present instance, the cover 11 is connected for hinging movement along either of two of its opposite edges. Releasable hinge couplings are used, as will be described in more detail hereinafter. The hinge couplings allow for left or right-handed opening as desired. The hatch is shown adapted for left-handed opening in FIG. 3.

Figure 2:
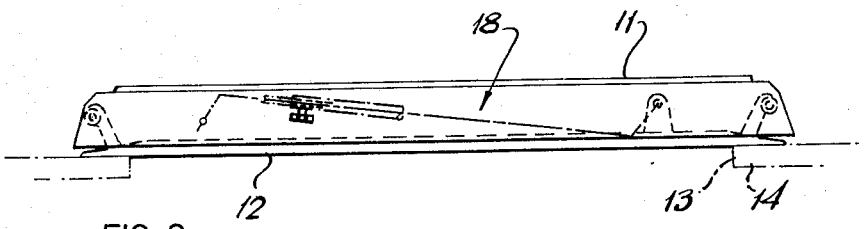
FIG. 2 is a side elevation of the hatch assembly shown in FIG. 1.
Figure 3:
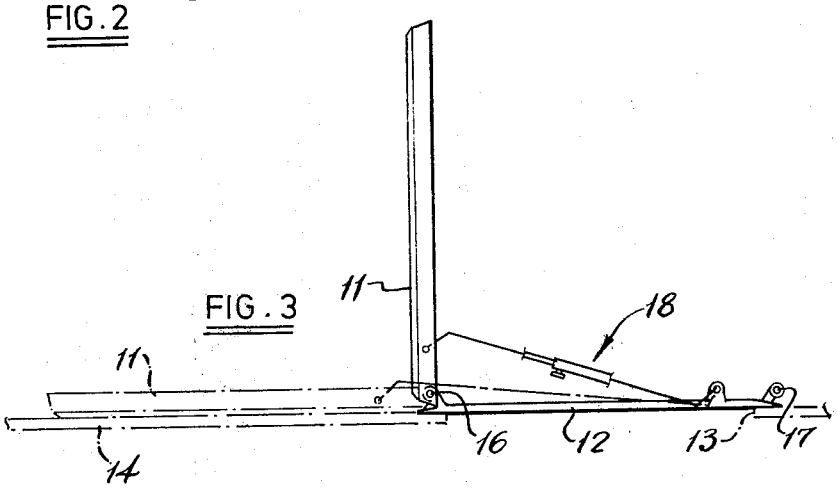
FIGS. 3 and 4 are diagrammatic side elevations illustrating the hatch assembly when open.

As seen in FIG. 3, the cover 11 is connected at 16 to the base frame 12 for left-handed opening, the hinge axis entering the plane of the drawing at 16. A second hinge coupling is provided to attach the cover 11 to the base frame 12 at 17, but is to be understood from FIG. 3 to be disconnected. The cover 11 can be progressively opened from a closed position, (FIG. 2), to an open position represented in full lines in FIG. 3 and be secured in these positions or in any intermediate position by a stay mechanism 18. The full line position of FIG. 3 corresponds to the greatest opening at which the cover 11 can be safely stayed. The cover 11 then has swung about the hinge axis at 16 through about 95°.

It is possible to open the cover 11 fully by swinging it through 180° to the position shown chaindotted in FIG. 3. The cover 11 is then resting on the deck 14, upside down.

Figure 4:
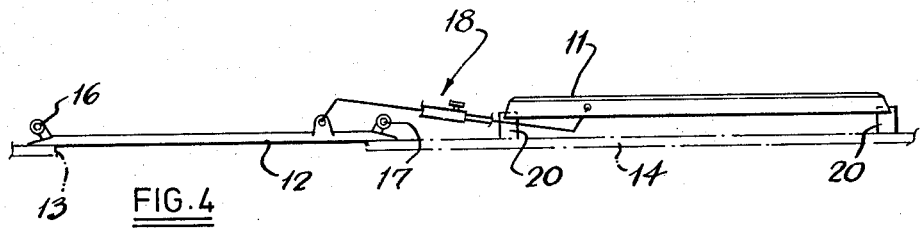
Figure 7:
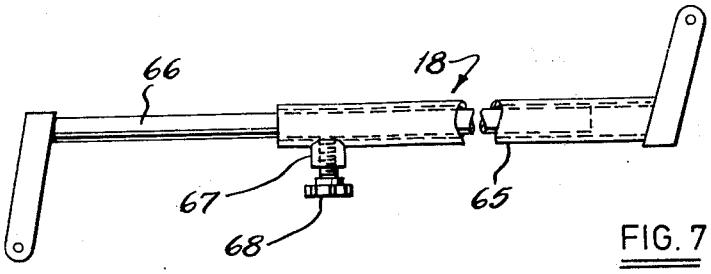
FIG. 7 is a side elevational view of a stay assembly forming part of the present hatch assembly.

If the hinge coupling at 16 is disconnected as well as the coupling at 17, then the hatch cover 11 can be removed completely from the base frame 12. This allows the cover 11 to be stored right way up to one side of the hatch opening 13. This is shown in FIG. 4. The cover 12 is supported at its corners by four recessed deck-mounted blocks 20. The stay mechanism 18 in this instance continually interconnects the hatch cover 11 and the base frame 12. Storing the hatch cover 11 as shown in FIG. 4 has the advantage that it cannot fill with water.

The hatch cover 11 in the present example is glazed, having a transparent plastics pane 21 screwed at intervals around its periphery to a cover rim 22. The pane-fastening screws may, if desired, enter the pane 21 from underneath. The cover rim 22 may be cast or fabricated from metals such as aluminum or its alloys, bronze or stainless steel, or moulded from a plastics material. As can be seen the rim 22 is shaped to define a rebate 23 which receives the periphery of the pane 21. The precise cross-section of the cover rim 22 is largely a matter of choice. The illustrated rim is cut away between pane anchorages 24 to provide lightness coupled with adequate mechanical strength and rigidity.

Two opposite sides 26, 27 of the rim 22 are hollowed out inwardly of the outer lip 28 thereof to form a groove 30. Each side includes releasable hinge coupling members 31 located within the grooves 30. The releasable hinge couplings can be released from outside, that is from on deck, by means of a key 32 insertable into a key opening 33. Hand grips 35 are integrally formed in the sides 26, 27 to facilitate raising of the hatch.

The remaining two opposite sides 36, 37 of the cover rim 22 are likewise hollowed out inwardly of their outer lips 38 to form grooves 40 which receive associated stay mechanisms 18.

Each of the releasable hinge couplings 31 comprises an espagnolette bolt. The espagnolette bolt has two arms 41 whose remote free ends form stub hinge pins 42. The adjacent ends of the arms 41 have slots 43 which are engaged with a driver 44. The driver 44 in this particular design includes a drive disc 45 mounted on a shaft 46. The shaft 46 is journalled for rotation in a hub portion 47 centrally located in the associated side 26 or 27. A pair of drive dogs 49 project axially away from one face of the drive disc 45. The dogs are each accommodated in the slot 43 of a respective one of the arms 41. As can be seen, an entry end of each slot is flared or V-shaped to assure smoothness of operation of the espagnolette bolt.

Figures 5, 5A, 6, 11:
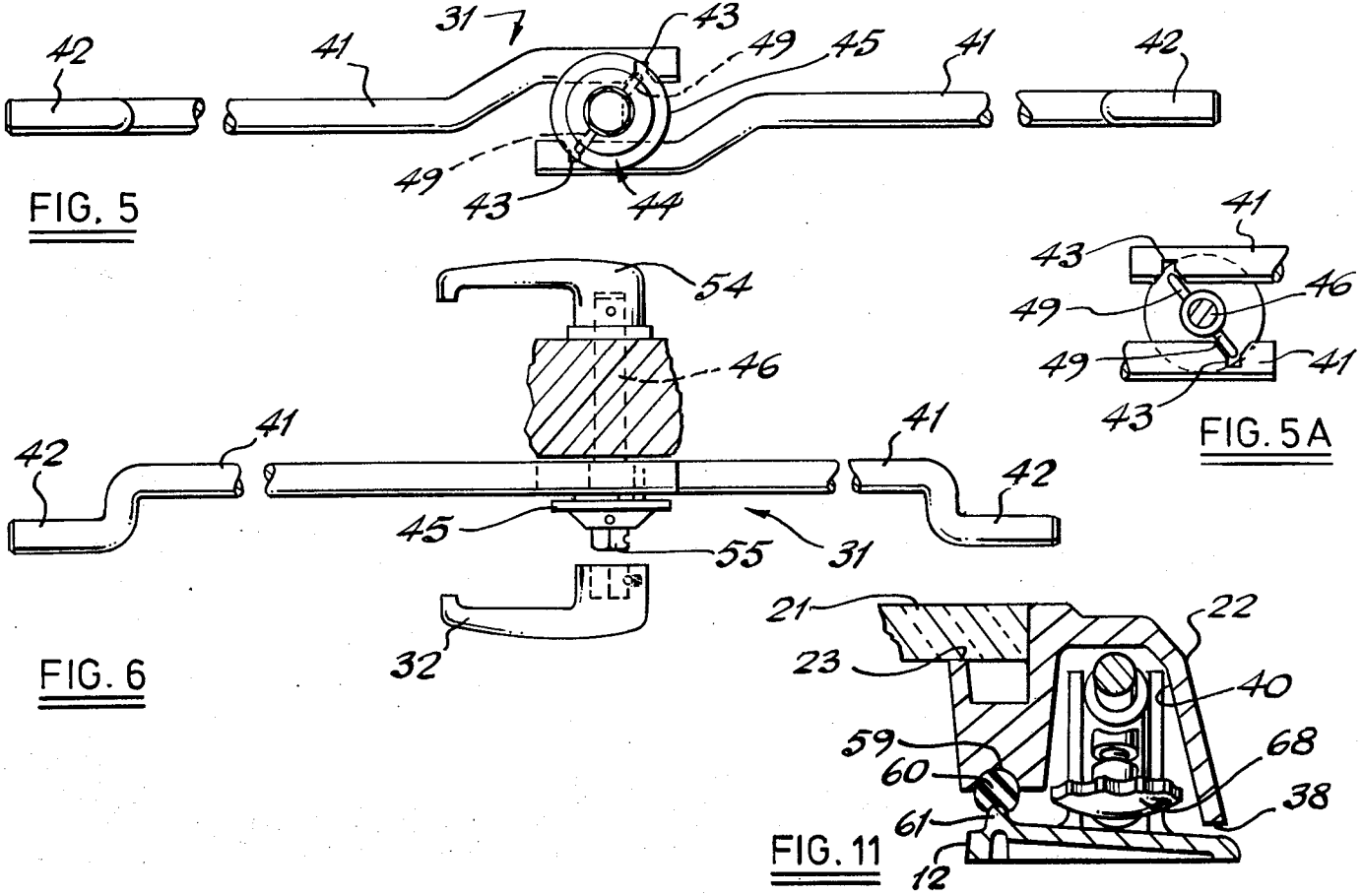
FIGS. 5 and 5*a* are partial elevational views of an espagnolette bolt viewed from opposite sides thereof and forming part of the present hatch assembly.
FIG. 6 is a partial plan view of the espagnolette bolt.
FIG. 11 is a sectional view taken on the line XI—XI of FIG. 1.

It will be appreciated that when the disc 45 is rotated anticlockwise as viewed in FIG. 5, the arms 41 are shifted longitudinally so as to move the hinge pins 42 further apart from one another. This corresponds to a locking action of the espagnolette bolt. When the hatch cover 11 is correctly registered with the base frame 12 and both bolts are operated to lock, the two hinge pins 42 of each bolt enter a pair of spaced hinge receivers 50. The cover 11 is then locked to the base member 12 along its opposite edges 26, 27.

The hinge receivers 50 comprise upstanding brackets mounted on the base frame 12, or integrally formed therewith as shown in the drawings. Each receiver has a bore 51 therein. The receivers 50 associated with a given bolt have their bores aligned with one another and with the hinge axis 16 or 17. The spacing between the receivers 50 of each pair thereof is not less than the overall length of the associated espagnolette bolt when in the unlocked condition. The bores 51 in the receivers 50 are preferably flared to assist entry of the corresponding hinge pins 42 as the espagnolette bolts are actuated to lock the hatch cover 11.

If it is desired to unlock the hatch cover 11, only one espagnolette bolt needs unlocking. This withdraws the hinge pins 42 thereof from their hinge receivers 50, and the hatch cover 11 can then be swung open about the other, still locked espagnolette bolt. Left or right-handed opening is obtainable at will, depending upon which espagnolette bolt is released. By releasing both bolts, the hatch cover 11 can be detached from the base member 12 and stored as illustrated in FIG. 4.

Both espeagnolette bolts are operable from within the boat and from the deck. Operation from within is achieved by turning inner handles 54 which are fast with the shaft 46 of the driver 44. The bolts are operated from the deck by means of the detachable keys 32 mentioned earlier. Each key has a socket end which conforms and mates with a square or hexogonal end portion 55 of the shaft 46. Desirably, a detent such as a spring-urged ball is associated with each key 32 and end portion 55 to secure them detachably together.

The outer skirt portion of the cover rim 22 is appropriately apertured to form the key opening 33; the latter provides access to the shaft end portion 55. Approximately a quarter turn of the keys 32 or handles 54 only is required to lock and unlock the espagnolette bolts.

When a vessel to which the hatch assembly is fitted is occupied, it is envisaged that the keys 32 will be retained on their associated end portions. Upon leaving the vessel unattended, the keys are removed.

The working parts of the espagnolette bolts are fully enclosed within the cover rim grooves 30, a cover plate 58 being secured to the cover rim as seen in FIG. 8.

As will be seen from FIGS. 8 to 11, the underside of the cover rim 22 is grooved at 59 and a sealing gasket 60 is bonded therein. When the hatch cover 11 is locked to the base member 12, a sealing ridge 61 thereon co-operates with the gasket 60 to make the closed hatch assembly watertight. The base member 12 has an upper surface the major portion of which slopes downwardly and outwardly. Thus water which may wash between the lip 28 of the cover rim 22 and the base member 12 will tend not to accumulate, but will drain away.

The stay mechanisms 18 each comprise a pair of slidably-connected stay members 65, 66. Member 65 comprises a tube within which a rod forming member 66 is telescopically received. In this particular design, a threaded side tube 67 is fast with member 65 and a locking hand screw 68 is provided to enable the rod to be jammed in a desired position within the tube member 65. Crank arms 69 are secured to an end of each of the members 65 and 66. In turn, the crank arms 69 are pivotally connected one to the cover rim 22 and one to the base member 12 respectively. See FIGS. 9 and 11.

Various modifications to the illustrated construction will be apparent to the designer. For example, hatch mountings other than the base member 12 could be employed. Thus, mountings similar or equivalent to the hinge brackets 50 could be employed alone, without the base frame 12, such mountings being secured directly to the deck or hatch coaming. Again, it is not essential for the hatch cover to have two espagnolette bolts. One espagnolette bolt and fastening clips, substituted for the second bolt of the illustrated embodiment, could be used instead. The fastening clips can be of any convenient type available on the market. It is not essential for the stay mechanisms to possess a locking screw 68. The mechanisms can take the form of friction stays which frictionally retain the hatch cover 11 in any desired open attitude. Eliminating the locking screw 68 and its associated side tube 67 will help the designer to develop a low-profile assembly.

Numerous advantages possessed by the hatch described above will be readily recognised. Amongst these advantages are the ability to open the hatch by pivoting it left-handedly or right-handedly at will. The design is particularly clean and free from projections, especially as regards the hinge mechanisms, so that the risk of injury to the yachtsman, or of damage to clothing and sails is minimised substantially. As disclosed, the major part of each of the hinge mechanisms 16, 17 is shrouded within the body of the rim 22 by the cover plate 58 and hence is protected from the weather. Another advantage of the design is the ability to stand the fully-opened hatch cover either way up, as illustrated in FIGS. 3 and 4.

I claim:

1. A four-sided hatch assembly for covering a hatch opening for boats and ships, comprising:

a hatch cover having peripheral recesses along at least two opposite sides thereof;

a hatch mounting including at least four upstanding apertured bolt receivers distributed about the periphery of said hatch opening, each of said apertures having an at least substantially closed periphery;

two separately-operable espagnolette bolts housed one in each of said two hatch cover recesses and disposed parallel to one another, said espagnolette bolts both serving the dual functions of positively fastening said hatch cover to said hatch mounting and of hinging said hatch cover thereto, said espagnolette bolts each including a pair of arms, each arm having a remote free end selectively engageable with at least one of said bolt receiver apertures, the engaged arms being positively retained in their associated apertures when engaged therewith to permit pivotal movement of an engaged pair of arms of one espagnolette bolt in their associated apertures when the arms of the other espagnolette bolt are disengaged from their associated apertures but to substantially prevent relative displacement between said engaged arms and their associated bolt receivers in a direction perpendicular to the longitudinal axis of the respective arms; and operating means coupled to said espagnolette bolts and operable from both inside and outside the hatch for extending or retracting said remote ends of each of said espagnolette bolts to selectively engage and disengage said arm ends from said bolt receiver apertures;

said upstanding apertured bolt receivers being positioned to enter said hatch cover recesses to cooperate with said espagnolette bolts, and said apertured bolt receivers being upstanding an amount sufficient to permit substantially 180° movement of the hatch cover thereabout when the arm ends of an espagnolette bolt are engaged in their respective bolt receiver apertures;

whereby a. when both espagnolette bolts are extended into their associated bolt receivers, said hatch cover is locked in a closed position, b. when a selected one only of said bolts is retracted from its associated bolt receivers, said hatch cover is pivotally and positively secured to said hatch mounting to be swung open about a hinge axis defined by the other espagnolette bolt, and c. when both of said espagnolette bolts are retracted from their bolt receivers, said hatch cover is freed for detachment from said hatch mounting.

2. A hatch assembly according to claim 1, including a stay mechanism coupled to said hatch cover for securing said hatch cover in any desired position when opened.

3. A hatch assembly according to claim 3, wherein said stay mechanism comprises a friction stay.

4. A hatch assembly according to claim 2, wherein said hatch cover has a further recess therein in another side thereof to accommodate said stay mechanism when said hatch cover is closed.

5. A hatch assembly according to claim 1, wherein said hatch mounting further comprises a base member in the form of a frame for securing around the hatch opening, said frame including said at least four upstanding apertured bolt receivers.

6. A hatch assembly according to claim 1, wherein said apertured bolt receivers comprise upstanding, bored lugs, arranged in spaced pairs, the bores of each pair of lugs being mutually aligned so that each pair is operable with a selected one of said espagnolette bolts.

* * * * *